US005579798A

United States Patent [19]

Pruitt

[11] Patent Number: 5,579,798

[45] Date of Patent: Dec. 3, 1996

[54] APPARATUS AND METHOD FOR ANCHORING A COVERING

[76] Inventor: Anthony E. Pruitt, 3752 Vineyard Ct., Marietta, Ga. 30062

[21] Appl. No.: 452,426

[22] Filed: May 26, 1995

[51] Int. Cl.[6] ..... E04H 15/62

[52] U.S. Cl. ..... 135/118; 5/419; 5/417; 248/545; 248/156

[58] Field of Search ..... 135/119, 118; 5/417–420; 248/508, 499, 545, 156; D6/601–603

[56] References Cited

U.S. PATENT DOCUMENTS

| | | | |
|---|---|---|---|
| 3,935,653 | 2/1976 | Klein | 40/125 H |
| 4,914,767 | 4/1990 | Balicki et al. | 135/118 X |
| 4,927,118 | 5/1990 | Pierorazio | 248/545 |
| 5,101,525 | 4/1992 | Ippolito | 5/417 |
| 5,150,485 | 9/1992 | Maguire | 5/417 |
| 5,158,258 | 10/1992 | McFadzean | 135/118 X |
| 5,176,354 | 1/1993 | Feigenbaum, Jr. | 135/118 X |
| 5,245,715 | 9/1993 | Dinkins | 5/417 |
| 5,299,331 | 4/1994 | Badillo | 5/417 |
| 5,327,922 | 7/1994 | Deroche | 135/118 |
| 5,390,890 | 2/1995 | Ferguson et al. | 135/118 X |

*Primary Examiner*—Lanna Mai
*Attorney, Agent, or Firm*—Louis T. Isaf, P.C.; R. Stevan Coursey

[57] ABSTRACT

The present invention includes a covering anchor device capable of anchoring various types of coverings, including beach towels and picnic blankets, to the ground. In accordance with the preferred embodiment, the covering anchor device includes a restraining portion which defines a V-shaped passageway extending through the restraining portion. The restraining portion includes a plurality of opposite protrusions which extend into the passageway to engage and exert restraining forces on a portion of a covering residing within the passageway. The opposite protrusions divide the passageway into a plurality of subpassages and form gaps between each pair of opposing protrusions. The width of subpassages and gaps decreases for each subpassage and gap located progressively nearer an end of the passageway, thereby increasing the restraining force exerted on a portion of the covering passing through such subpassages and gaps. The covering anchor device also includes a grip portion located above the restraining portion and a ground interface portion depending from the restraining portion. In accordance with a preferred method, a portion of the covering is pulled through the passageway, by a user, to engage the covering and protrusions. The ground interface portion is then pushed into the ground by a user placing a palm on an upper surface of the grip portion and subsequently exerting downward pressure on the grip portion. Once the ground interface portion is positioned in the ground, the restraining forces exerted on the covering discourage disengagement of the covering and the covering anchor device, thereby restraining the covering at the desired location.

6 Claims, 3 Drawing Sheets

APPARATUS AND METHOD FOR ANCHORING A COVERING

BACKGROUND OF THE INVENTION

This invention relates to the field of anchoring devices and, more particularly, to the field of devices for anchoring various types of coverings, including recreational ground coverings, to the ground.

Beach goers and picnickers are frequently annoyed and troubled by flyaway beach towels, picnic blankets, sheets, and other ground coverings on a windy day at the beach. In addition, beach goers, picnickers, and their food and belongings are often subject to an annoying spray of beach sand, dirt, or other unwanted debris that is thrown into the air by a loose towel or blanket corner caught in a gust of wind. For many years, beach goers and picnickers have attempted to solve these problems by placing various objects, including shoes, coolers, and radios, on top of the corners of their ground coverings. However, such solutions are generally temporary because the objects are often moved, for instance, to go for a walk on the beach or to change the station on the radio.

A number of other anchoring devices have been devised in an effort to deal with these problems. However, some previous anchoring devices are relatively complicated in structure and use, and include moving parts which require bothersome assembly by the user. Due, in part, to their more complicated structure, the durability and reliability of those anchoring devices may be diminished. Other previous anchoring devices required the use of specially designed coverings or necessitated permanent alterations to existing coverings. For instance, one such anchoring device required the use of a corresponding beach towel with specially manufactured holes and grommets in the corners. Because they required special coverings or permanent disfigurement to other coverings, such anchoring devices have not been successful at resolving the problems faced by beach goers and picnickers.

There is, therefore, a need in the industry for an apparatus and method that sufficiently anchors coverings to the ground and solves other related and unrelated problems.

SUMMARY OF THE INVENTION

Briefly described, the present invention includes a covering anchor device, and related method, that functions to restrain a covering, or parts of a covering, from becoming airborn in a gust of wind. More particularly, the covering anchor device functions to passively and directly restrain a covering.

In accordance with the present invention, the covering anchor device defines a passageway which receives a portion of a covering. The covering anchor device includes a protrusion (or tooth) which extends into the passageway. In use, a portion of a covering, preferably, a corner, is fed through the passageway, thereby bringing the covering into engagement with the protrusion. Thereafter, the engagement of the protrusion and covering restrains the covering from escaping the passageway when the covering is acted upon by other forces which would, otherwise, tend to cause the covering to be repositioned.

More specifically, the present invention includes a covering anchor device defining a passageway having a top edge and a bottom edge which converge to a right end and a left end. Each edge includes a plurality of opposite protrusions (or teeth) which extend into the passageway and cooperate to form a series of gaps and subpassages. Each subpassage has a width which, starting with a largest subpassage, decreases gradually for each subpassage located successively closer to an end. Similarly, each gap has a width which, starting with the largest gaps, decreases gradually for each gap located successively closer to an end. In use, coverings having greater thickness are engaged by opposite protrusions forming gaps with greater gap widths, while coverings having lesser thickness are engaged by opposite protrusions forming gaps with lesser gap widths. The engagement of the covering and protrusions provides sufficient restraining force acting on the covering to limit movement of the covering. Because the passageway includes a variety of gap widths, a wide variety of coverings (including, but not limited to, beach towels, picnic blankets, sheets, tarps, and tents) are restrainable by the covering anchor device.

In accordance with the preferred embodiment of the present invention, the covering anchor device comprises a restraining portion, a ground interface portion, and a grip portion integrally forming a, generally, T-shape. The restraining portion defines a passageway having a, generally, V-shape and includes a plurality of opposite protrusions which extend into the passageway from top and bottom edges to form a series of gaps and subpassages. The widths of the gaps and subpassages lessen gradually for gaps and subpassages located successively nearer ends of the passageway. The ground interface portion resists movement of the covering anchor device relative to a ground surface and is shown in the preferred embodiment as a stake depending from the restraining portion which tapers to a blunt point. The grip portion is positioned above the restraining portion and has an ergonomically-shaped surface for receipt of a user's palm.

The covering anchor device, in accordance with a preferred method, receives a portion of a covering which is threaded, by a user, through the largest subpassage of the passageway and through gaps nearest the largest subpassage to engage at least one pair of opposite protrusions or teeth. As the user pulls more of the covering through the largest subpassage, the covering is received by subpassages and gaps located progressively further away from the largest subpassage, thereby engaging increased numbers of opposite protrusions. Upon the engagement of as many opposite protrusions as possible (the actual number being dictated by the thickness of the particular covering and the gap widths of the passageway), the ground interface portion of the covering anchor device is received by the ground (assisted by a user placing a palm on the grip portion followed by the exertion of a downward force on the grip portion) which, preferably, includes beach sand or other loosely packed soil. Additional covering anchor devices are employed, in the same manner, at other portions of the covering, preferably at the corners, to provide increased anchoring of the covering.

It is therefore an object of the present invention to receive and restrain movement of a beach towel or other covering.

Another object of the present invention is to define a passageway for receipt of a beach towel or other covering.

Yet another object of the present invention is to define a passageway for receipt of a beach towel or other covering, having a plurality of protrusions or teeth which engage and restrain the beach towel or other covering.

Still another object of the present invention is to create a series of gaps and subpassages having decreasingly-sized widths for receipt of a beach towel or other covering.

Still another object of the present invention is to enhance restraint of a beach towel or other covering through use of a V-shaped passageway for receipt of the beach towel or other covering.

Still another object of the present invention is to engage and restrain beach towels and other coverings having different thicknesses.

Still another object of the present invention is to firmly and reliably anchor a beach towel or other covering to the ground.

Still another object of the present invention is to firmly and reliably anchor a beach towel or other covering to the ground without damaging or altering the beach towel or other covering.

Still another object of the present invention is to inexpensively anchor a beach towel or other covering to the ground.

Still another object of the present invention is to anchor a beach towel or other covering with a one-piece device having no moving parts.

Still another object of the present invention is to anchor a beach towel or other covering with a readily portable device.

Still another object of the present invention is to anchor a beach towel or other covering with a device having at least one surface suitable for placement of advertisements.

Other objects, features, and advantages of the present invention will become apparent upon reading and understanding this specification, when taken in conjunction with the accompanying drawings.

DETAILED DESCRIPTION OF THE PREFERRED EMBODIMENT

Figure 1:
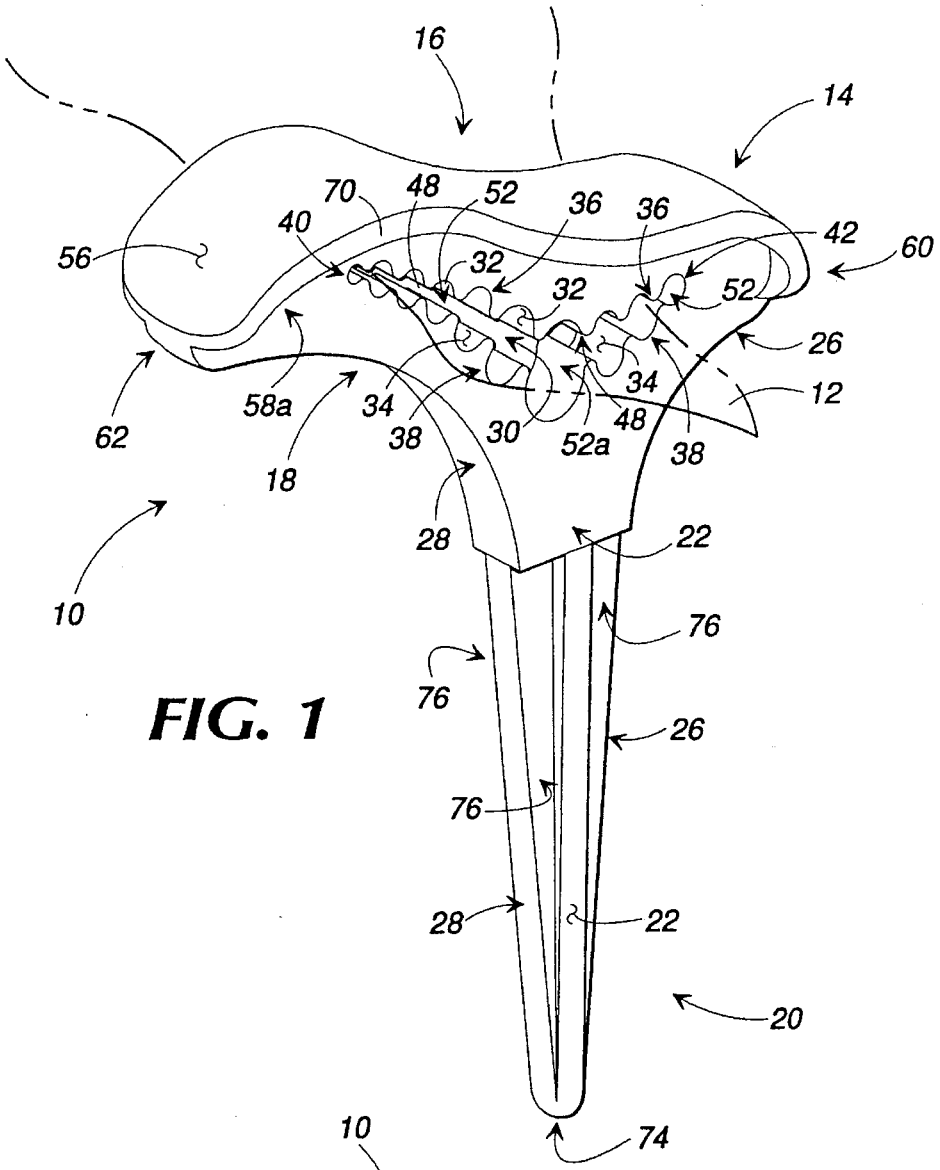
FIG. 1 is a perspective view of a covering anchor device in accordance with the preferred embodiment of the present invention, showing a covering residing within a passageway.
Figure 4:
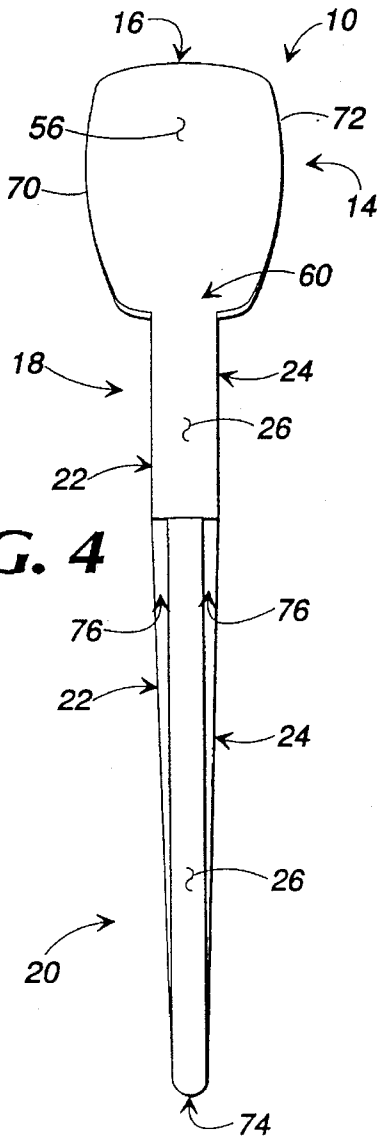
FIG. 4 is a right side, elevational view of the covering anchor of FIG. 1.
Figure 2:
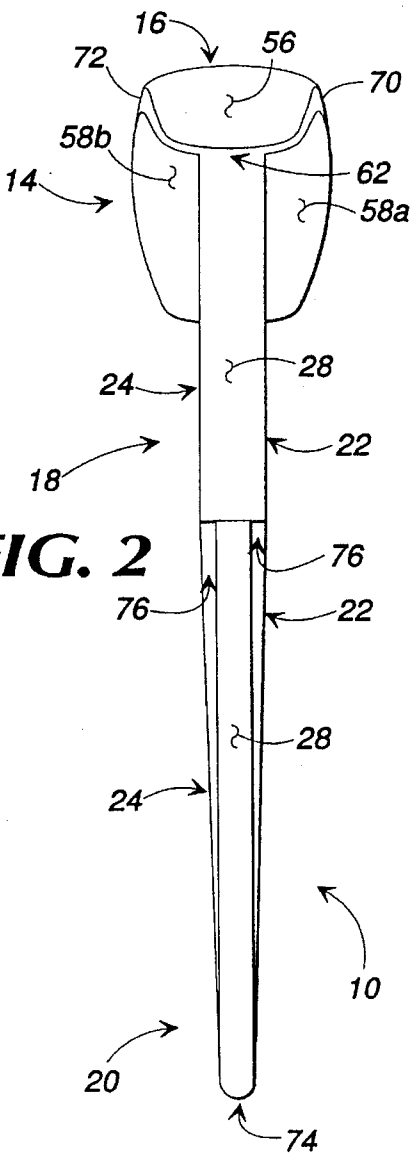
FIG. 2 is a left side, elevational view of the covering anchor of FIG. 1.

Referring now to the drawings in which like numerals represent like components throughout the several views, FIG. 1 is a perspective view of a covering anchor device 10, in accordance with the preferred embodiment of the present invention, restraining a covering 12. The covering anchor device 10 has a, generally, T-shape and is manufactured, preferably, as a single piece from rigid injection-molded plastic. The covering anchor device 10 includes a grip portion 14 located near a top 16, a restraining portion 18 positioned beneath the grip portion 14, and a ground interface portion 20 in the form of a stake depending from the restraining portion 18. As seen in FIG. 2, the covering anchor device 10 also has a front surface 22 and a back surface 24 which extend between the restraining portion 18 and the ground interface portion 20. A right side surface 26 and a left side surface 28 (see FIGS. 2 and 4) similarly extend between the restraining portion 18 and the ground interface portion 20.

Figure 3:
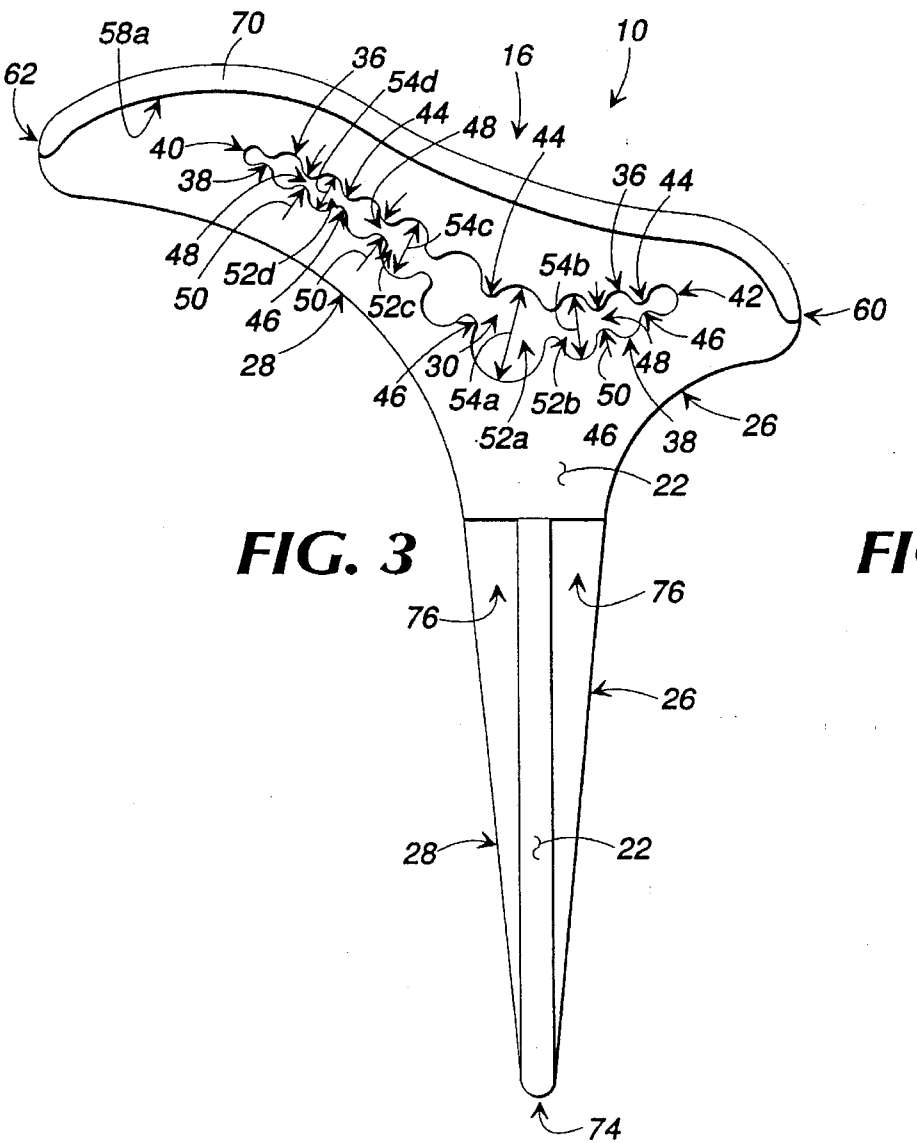
FIG. 3 is a front, elevational view of the covering anchor of FIG. 1.

The restraining portion 18, as illustrated in FIG. 1, defines a passageway 30 extending between the front surface 22 and the back surface 24 which receives the covering 12. A top internal surface 32 and an opposing bottom internal surface 34 bound the passageway 30 and form a top edge 36 and an opposing bottom edge 38, respectively, at their intersection with the front surface 22 and back surface 24. The top internal surface 32 and bottom internal surface 34 (and, hence, the top edge 36 and bottom edge 38) converge and meet at a left end 40 and a right end 42. As shown in FIG. 3, the top and bottom edges 36,38 form, preferably, a V-shaped passageway 30. It is believed that the V-shape increases the downward restraining force exerted by the covering anchor device 10 on the covering 12, thereby improving restraining performance. In an alternate embodiment, the top and bottom edges 36',38' are each positioned horizontally to form a passageway 30' having a, generally, horizontal orientation instead of the V-shape of the preferred embodiment.

In accordance with the preferred embodiment, the top edge 36 defines a plurality of top protrusions 44 which extend into the passageway 30. Similarly, the bottom edge 38 defines a plurality of bottom protrusions 46 which extend into the passageway 30 with each bottom protrusion 46 being opposite a top protrusion 44. Opposite top and bottom protrusions 44,46 cooperate to define a plurality of gaps 48 with each gap 48 having a gap width 50. Note that the gap widths 50, preferably, decrease gradually for gaps 48 located successively closer to the left and right ends 40,42, thereby better enabling the covering anchor device 10 to restrain coverings 12 such as sheets, which are thinner than beach towels or blankets. In an alternate embodiment, the gap widths 50' are constant in size for all gaps 48, regardless of their location relative to the left and right ends 40,42.

The top and bottom protrusions 44,46, in accordance with the preferred embodiment, also cooperate to divide the passageway 30 into a plurality of subpassages 52 having a, generally, circular shape. Each subpassage 52 has a subpassage width 54 and, preferably, subpassage **52*a* has the largest subpassage width 54*a*. Note that, starting with subpassage width 54*a*, the subpassage widths 54, preferably, decrease gradually for subpassages 52 located progressively closer to the left and right ends 40,42. It is understood that the scope of the present invention includes a passageway 30 having a plurality of subpassages 52 which have constant subpassage widths 54**.

Figure 5:
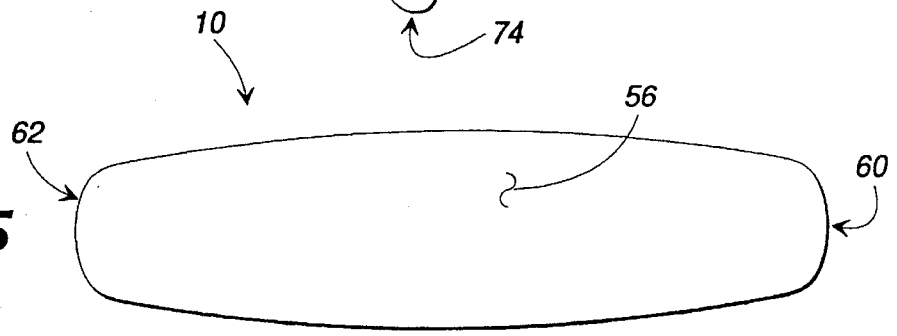
FIG. 5 is a top view of the covering anchor of FIG. 1.
Figure 6:
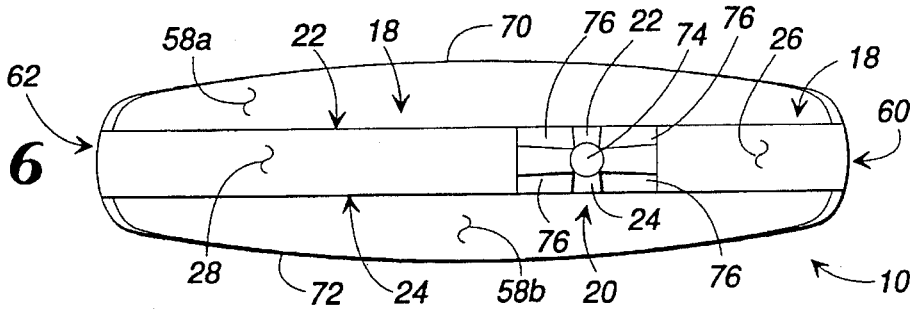
FIG. 6 is a bottom view of the covering anchor of FIG. 1.
Figure 7:
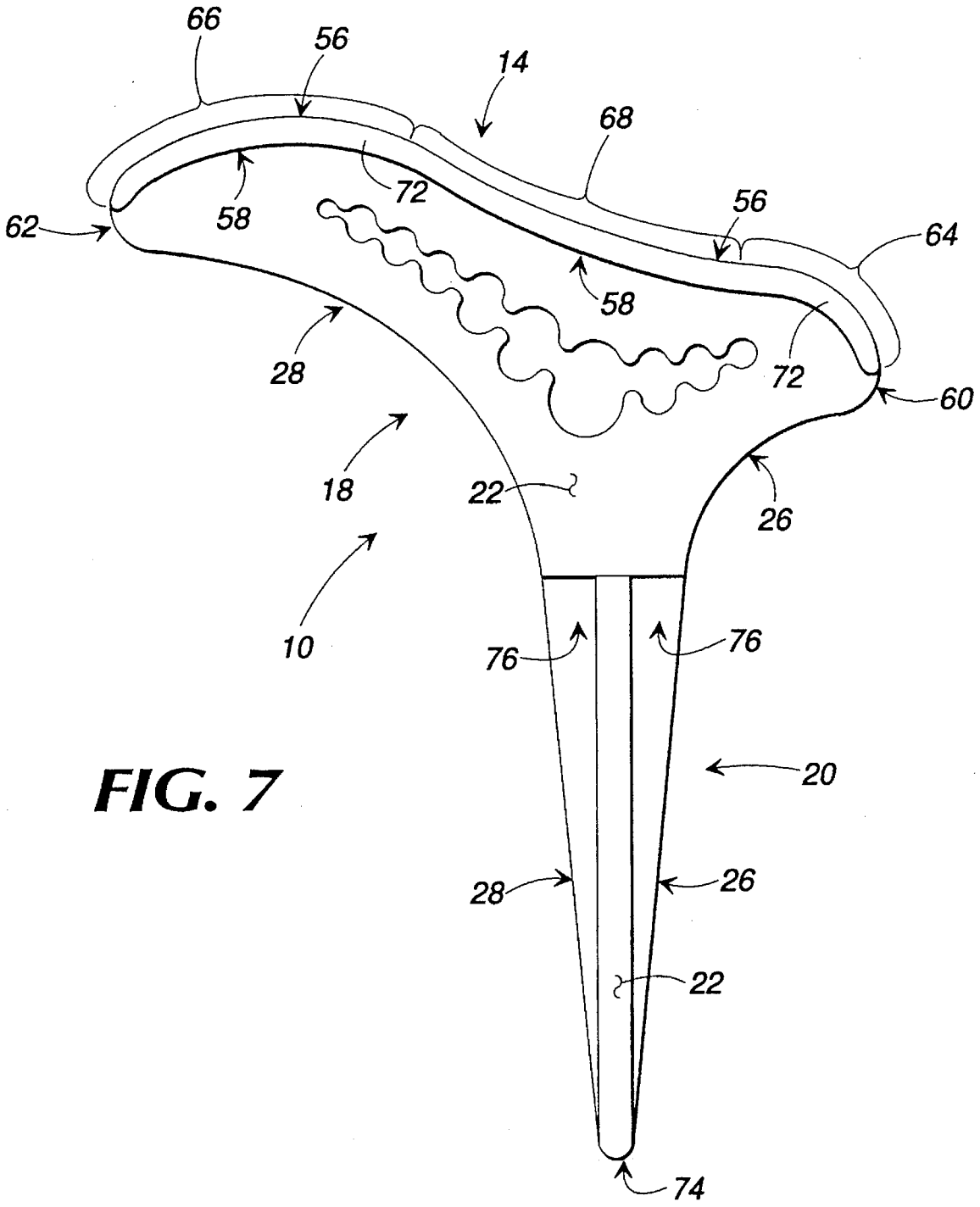
FIG. 7 is front, elevational view of the covering anchor of FIG. 1, illustrating the location of various grip sections.

As seen in FIGS. 5 and 6, the grip portion 14 includes an upper surface 56 and lower surfaces 58. The right side surface 26 and the left side surface 28 curve upward and outward (see FIG. 7) to blend with the upper surface 56 at a fight end 60 and a left end 62, respectively, of the grip portion 14. The upper surface 56 (see FIG. 7) extends between the right end 60 and the left end 62 and, preferably, includes a first convex section 64 proximate to the right end 60, a second convex section 66 proximate to the left end 62, and a concave section 68 to transition between the first and second convex sections 64,66. The lower surfaces **58*a,b* intersect the front surface 22 and the back surface 24, respectively, and extend forward and rearward, respectively, to a front grip edge 70 and a back grip edge 72**.

The ground interface portion 20, in accordance with the preferred embodiment and as shown most clearly in FIGS. 2, 3, 4, and 6, extends downward from the restraining portion 18 to a blunt point 74. As seen in the figures, the front, back, right, and left surfaces 22,24,26,28 each taper toward the blunt point 74 and define a plurality of insets 76. It is understood that the scope of the present invention includes ground interface portions 20 having other shapes.

In accordance with a preferred method of the present invention, the passageway 30 receives a corner of the covering 12, as illustrated in FIG. 1, such that the corner first threads through subpassage 52*a* (by a user positioning the covering corner on a first side of the subpassage 52*a* and then pulling the covering corner through the subpassage 52*a* toward a second side of the subpassage 52*a*). As the covering 12 is received by subpassage 52*a*, it is also received by the gaps 48 and subpassages 52 nearest the subpassage 52*a*. The top and bottom protrusions 44,46 engage the covering 12 at the gaps 48, while the covering 12 is allowed to bunch-up in the subpassages 52. Other portions of the covering 12 are received by the remaining gaps 48 and subpassages 52 located progressively closer to the ends 40,42 of the passageway 30 as more of the covering 12 is pulled through the passageway 30. Additionally, an increased number of top and bottom protrusions 44,46 engage the covering 12 at the gaps 48. Restraining forces exerted on the covering 12 by the protrusions 44,46 serve to restrain the covering 12 by resisting other forces (i.e. created by wind or other sources) attempting to disengage the covering 12 from the covering anchor device 10. It is understood that the scope of the preferred method includes receipt of other portions of the covering 12 by the passageway 30.

The ground interface portion 20 is received by the ground when downward forces are imposed, by a user, upon the upper surface 56 of the grip portion 14 causing the blunt point 74 to slide into the ground at a desired location. The tapering of the front, back, right side, and left side surfaces 22,24,26,28 aids in reducing the quantity of downward force required to press the ground interface portion 20 into the ground. It is understood that the scope of the preferred method includes usage of more than one covering anchor device 10, if necessary for a particular situation, to anchor, perhaps, more than one portion of a covering 12 to the ground. For instance, when attempting to restrain a beach towel at the beach, a covering anchor device 10 is, preferably, utilized at each corner of the beach towel.

While the embodiment of the present invention which has been disclosed herein is the preferred form, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative relationships shown on the drawings are given as the preferred relative relationships, but the scope of the invention is not to be limited thereby.

I claim:

1. An apparatus for anchoring a covering to the ground, said apparatus comprising:

a restraining portion having a front surface and a back surface, said restraining portion defining a passageway extending between said front and back surfaces for receipt of a covering, said passageway having an upper edge and a lower edge each extending between a first end and a second end of said passageway;

a ground interface portion depending from said restraining portion, said ground interface portion having a point and a plurality of surfaces extending between said restraining portion and said point;

a grip portion extending above and overhanging said restraining portion, said grip portion including a first convex section and a second convex section separated from said first convex section by a concave section transitioning between said first and second convex sections, wherein said first convex section, said second convex section, and said concave section define an upper surface for receipt of a user's palm;

wherein a first plurality of protrusions extend downward from said upper edge of said passageway and a second plurality of protrusions extend upward from said lower edge of said passageway opposite said first plurality of protrusions, opposing protrusions of said first and second pluralities of protrusions defining a plurality of gaps therebetween and opposing protrusions of said first and second pluralities of protrusions further defining a plurality of adjacent subpassages interconnected by said plurality of gaps;

wherein each subpassage of said plurality of subpassages defines a subpassage width, said subpassage width of each of said plurality of subpassages decreasing for each subpassage of said plurality of subpassages located progressively nearer said first and second ends of said passageway from a widest subpassage located between said first end and said second end;

wherein each gap of said plurality of gaps defines a gap width, said gap width of each of said plurality of gaps decreasing for each gap of said plurality of gaps located progressively nearer said first and second ends of said passageway from said widest subpassage; and wherein said first plurality of protrusions is fixed relative to said second plurality of protrusions.

2. The apparatus of claim 1, wherein said plurality of surfaces defines a plurality of insets, each inset of said plurality of insets tapering between said restraining portion and said point.

3. The apparatus of claim 1, wherein each protrusion of said first and second pluralities of protrusions is rounded at a gap.

4. The apparatus of claim 1, wherein said pluralities of gaps and subpassages are oriented in a V-shaped configuration.

5. The apparatus of claim 1, wherein said restraining and ground interface portions define a common vertical plane.

6. The apparatus of claim 1, wherein said point is a blunt point.

* * * * *